US005182991A

United States Patent [19]

Patuszynski et al.

[11] Patent Number: 5,182,991

[45] Date of Patent: Feb. 2, 1993

[54] MULTI-POSITION INCREMENTAL DOCUMENT ENDORSER

[75] Inventors: Duane R. Patuszynski, Lincolnwood; John S. O'Callaghan, Wilmette; Andrew Bartoli, Arlington Heights, all of Ill.

[73] Assignee: Bell & Howell Document Management Products Company, Chicago, Ill.

[21] Appl. No.: 750,653

[22] Filed: Aug. 27, 1991

[51] Int. Cl.[5] ..... B41F 5/00

[52] U.S. Cl. ..... 101/216; 101/91; 101/153; 101/141

[58] Field of Search ..... 101/91, 92, 216, 219, 101/93.21, 93, 52, 55, 74, 78, 93.18, 93.19, 93.20, 141, 136, 152, 153

[56] References Cited

U.S. PATENT DOCUMENTS

| | | | |
|---|---|---|---|
| 2,997,949 | 8/1961 | Ritzerfeld et al. | 101/91 |
| 3,039,385 | 6/1962 | Siegel | 101/91 |
| 3,092,021 | 6/1963 | Gruver | 101/216 |
| 3,728,960 | 4/1973 | Heath | 101/216 |
| 4,278,023 | 7/1981 | Call et al. | 101/111 |
| 4,484,521 | 11/1984 | Frystak et al. | 101/235 |
| 4,538,515 | 9/1985 | Tymkewicz et al. | 101/216 |
| 4,572,069 | 2/1986 | Schwartzbeck | 101/216 |
| 4,739,701 | 4/1988 | Haug | 101/91 |
| 4,821,642 | 4/1989 | Schafer | 101/219 |

*Primary Examiner*—Edgar S. Burr
*Assistant Examiner*—Christopher A. Bennett
*Attorney, Agent, or Firm*—Willian Brinks Olds Hofer Gilson & Lione

[57] ABSTRACT

A bank check endorser is provided that permits endorsement in each of three discrete locations along the length of the reverse side of a check. The endorser unit utilizes a one-way clutch along the drive shaft to permit movement of the drive mechanism for the print cylinder. By releasing a latch mechanism, the housing portion, which contains the drive mechanism and the print cylinder, is moved along the length of the drive shaft to a second position.

16 Claims, 4 Drawing Sheets

Fig. 6
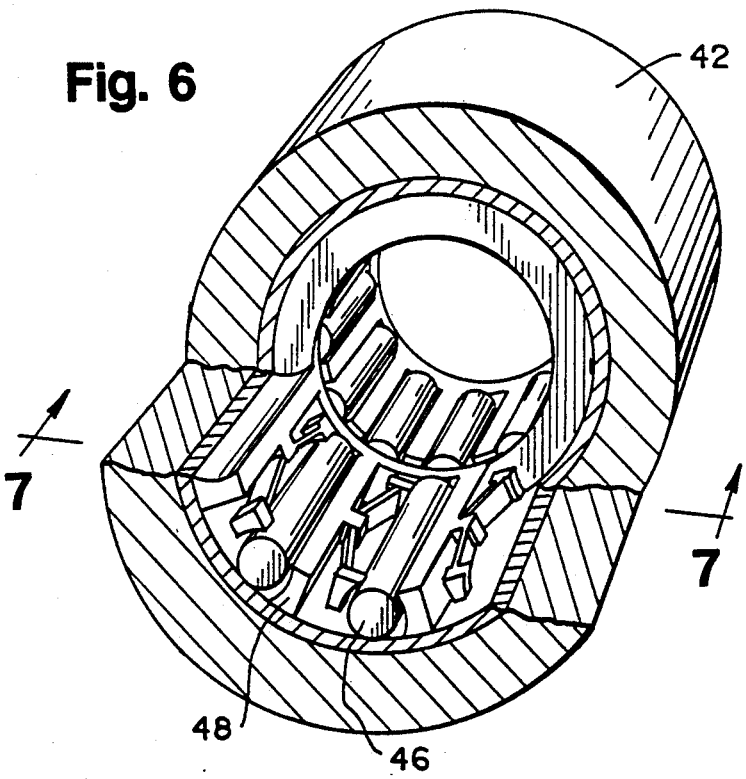
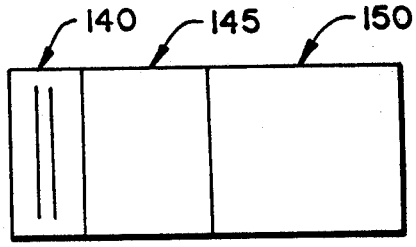
Fig. 8
Fig. 7
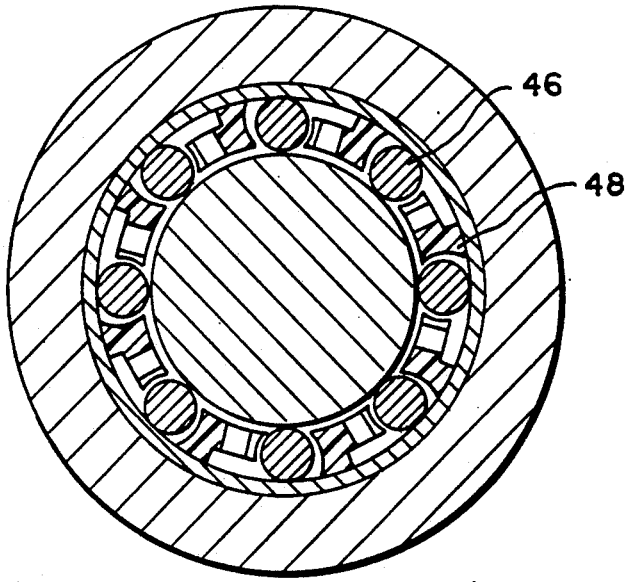

MULTI-POSITION INCREMENTAL DOCUMENT ENDORSER

BACKGROUND OF THE INVENTION

1. Field of the Invention

This invention relates generally to incremental document endorsers, such as those products which process and endorse bank checks and similar items. More particularly, this invention relates to a document endorser which allows endorsement in a number of locations on a document, with each document receiving only a single endorsement as it passes through the endorser. The multi-position feature permits various parties handling a document to each endorse the document in a separate, discrete location.

2. Description of the Prior Art

Document endorsers are known in the prior art. Such products are typically utilized by banks to process and endorse bank checks. After a check is endorsed by the payee, the depositing bank will also place its endorsement on the reverse side of the check. As the check travels through the banking system to the bank of the payor, each subsequent bank will typically place an endorsement on the reverse side of the check.

Document endorsement typically occurs in the banking operation as a portion of a larger document processing operation. The endorsing bank will endorse the check during a handling operation that often includes microfilming of the check. In addition to microfilming, batches of checks may be indexed and an image mark may be placed upon the microfilm to assist later retrieval of the microfilm copy of the document.

As a result of the lack of uniform requirements for the location of each endorsement on the reverse side of the check, endorser machines of the prior art have typically located the endorser unit in a fixed center position. As the document travels through the process of microfilming and recording, the endorser unit places an endorsement in a central location on the reverse side of the check. At each of the various banks which endorse the same check, an endorsement is placed in approximately the same location in the center of the reverse side of the check. Consequently, when the check is finally returned to the payor's bank, the endorsements of various banks are often overlapping and illegible.

In response to this situation, the federal government has issued regulations mandating specific, discrete locations for particular bank endorsements. Under the new regulations, the reverse side of the check is divided into three portions. The size of each portion is dictated by the federal regulations. The payee's endorsement is permitted only in the left-hand portion of the reverse side of the check. The endorsement of the bank of first deposit is then permitted only in the center portion of the check. Any subsequent bank's endorsement is permitted only in the right-hand portion of the check.

Thus, in response to the federal requirements, there is a need for an endorser unit that will endorse in positions other than the conventional, central endorsement position. To facilitate compliance with the federal requirements, an endorser unit is needed that is capable of providing endorsements in separate, discrete locations and can print an endorsement that is limited to the particular location.

The endorser unit of the present invention is a response to that need. The endorser of the present invention permits endorsement in multiple, discrete positions and includes features that add to the flexibility and desirability of the system.

SUMMARY OF THE INVENTION

The present invention is directed to providing a bank check endorser that permits endorsement in each of three discrete locations on the reverse side of the check. The endorser unit utilizes a translatable clutch along the drive shaft which allows movement of the drive mechanism for the print stamp along the length of the drive shaft to multiple locations for endorsement. Movement of the endorser unit permits endorsement in two different portions of the check. By feeding the checks reversed right to left, endorsement can be made a third portion of the check.

Thus, in accordance with one embodiment of this invention, a multi-position endorser for printing endorsements in a plurality of locations includes a print cylinder for placing a printed mark on a moving document. The moving document is transported by a series of belts or belts and rollers.

A housing holds the print cylinder in a first actuation position to permit endorsement in the first position. The housing is physically translatable to permit movement of the print cylinder to a second actuation position to permit endorsement in the second position. The housing is pivotally mounted on a drive shaft, with the physical translation of the housing being along the longitudinal axis of the drive shaft.

In the present invention, the endorser drive unit is physically translatable to permit endorsement in a plurality of positions. The endorser drive unit includes a plurality of clutches for actuation of the drive unit in both the first and second endorsement positions.

One clutch in the drive unit is a one-way clutch in that it permits rotation in a first direction and prevents rotation in the opposite direction. The one-way clutch provides rotational power from a drive shaft to the incremental drive mechanism of the endorser unit. The one-way feature permits translation of the clutch between the first and second endorsement or endorser actuation positions. This feature provides the multiple position endorsement feature of the present invention. The one-way clutch is connected to a bearing and a pinion gear, which are all disposed about the drive shaft.

The endorser also includes an incremental drive unit or Geneva drive mechanism for actuation of the print cylinder in the first endorsement position to provide a single imprint on each document. Such incremental drive units are known in the prior art and, apart from the other novel features, do not form a part of the present invention. The incremental endorser drive mechanism includes a resilient wire clutch (or incremental clutch) and an associated solenoid actuator. Electronic actuation of the solenoid actuator is effective to release the wire clutch and permit rotation of the print cylinder.

The housing of the endorser includes a latch for securing the housing in each endorsement position. The latch includes a plate member pivotally mounted to a set of side plates, and a hook member formed in the plate member. The latch also includes a grooved portion in a second shaft. The grooved portion is positioned for receiving the hook member to retain the housing in the endorsement positions.

The endorser also includes a base portion. The second shaft is mounted in the base portion by a pair of mounting holes, one located at each end of the second shaft. The mounting holes are eccentrically located with respect to the center of the cross section of the shaft. By rotation of the eccentrically mounted shaft, the pressure of the print mechanism against the document can be adjusted. The base portion also includes an inclined portion to direct movement of the housing from the first position to the second position over the belts.

BRIEF DESCRIPTION OF THE DRAWINGS

For a more complete understanding of this invention, reference should be made to the embodiments illustrated in greater detail in the accompanying drawings and described below by way of example of the invention. In the drawings:

FIG. 6 is a sectional view illustrating the details of the one-way translatable clutch;

FIG. 7 is a sectional view taken along line 7—7 of FIG. 6;

FIG. 8 is an illustration of a check, showing the three portions or areas for endorsement.

DETAILED DESCRIPTION OF THE DRAWINGS

Figure 1:
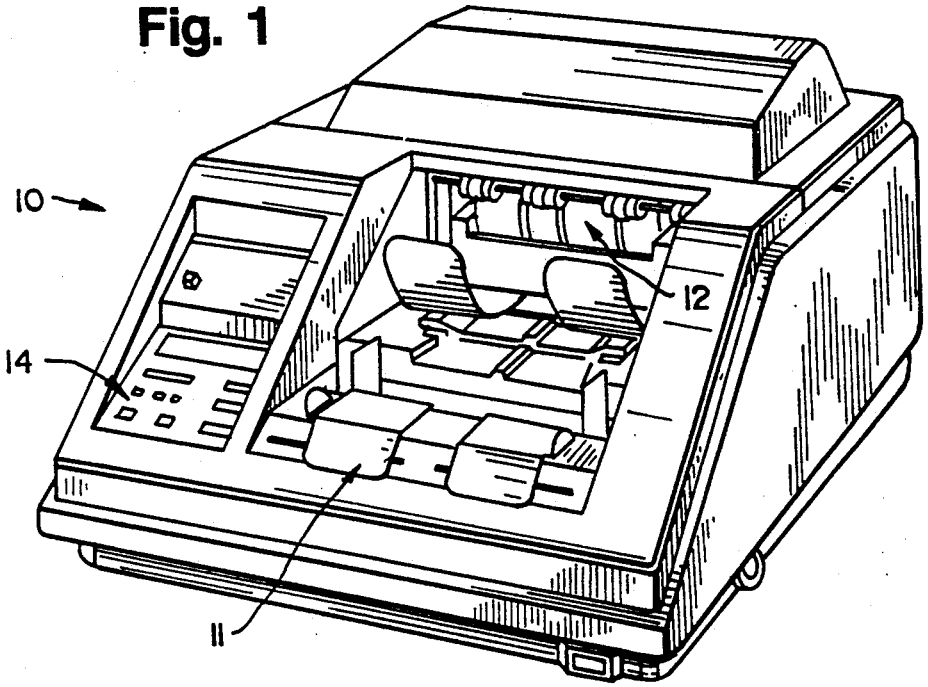
FIG. 1 is a perspective view of the document recorder and endorser unit, illustrating the outside of the unit.
Figure 2:
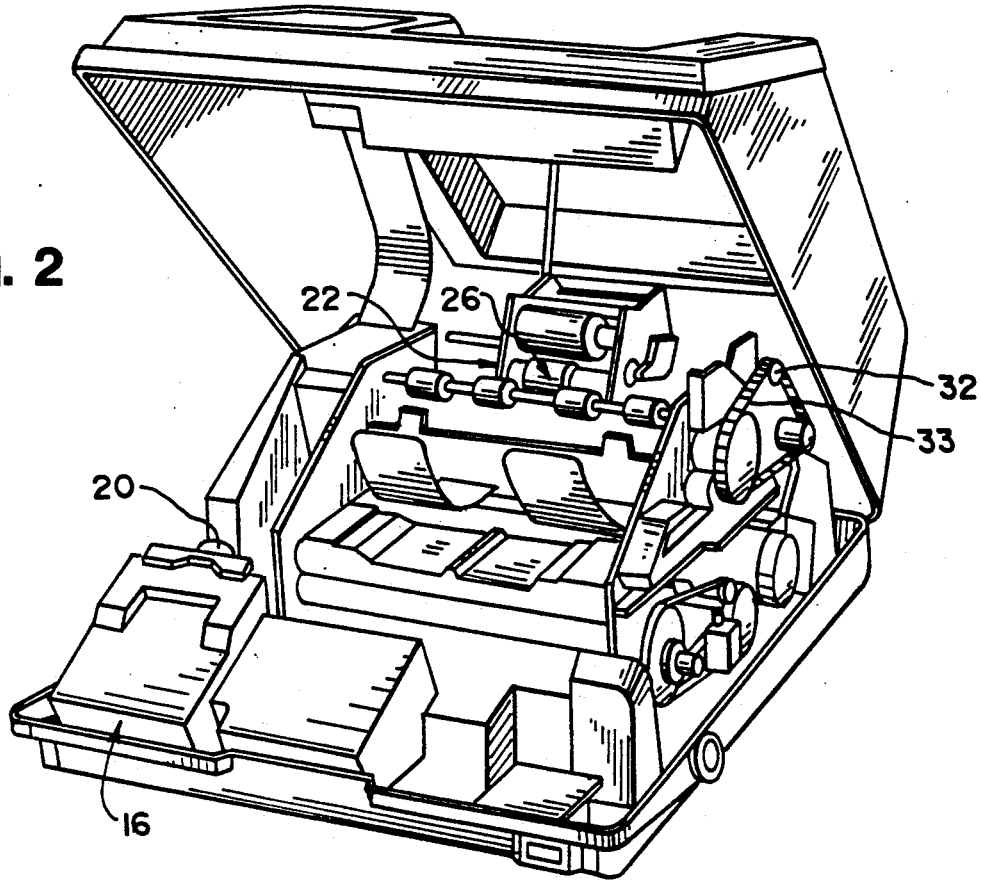
FIG. 2 is a perspective view of the document recorder and endorser unit, illustrating the inside of the unit and location of the endorser.

Turning now to the drawings, a document recorder with the endorser unit installed is shown in FIGS. 1 and 2, generally at 10. The recorder unit includes a document feeding station 11 and document transport means 12, which comprises a series of belts and rollers to carry the check into the endorser. Belts and rollers for document transport are known in the prior art. A control panel 14 monitors the various functions of the unit.

Figure 3:
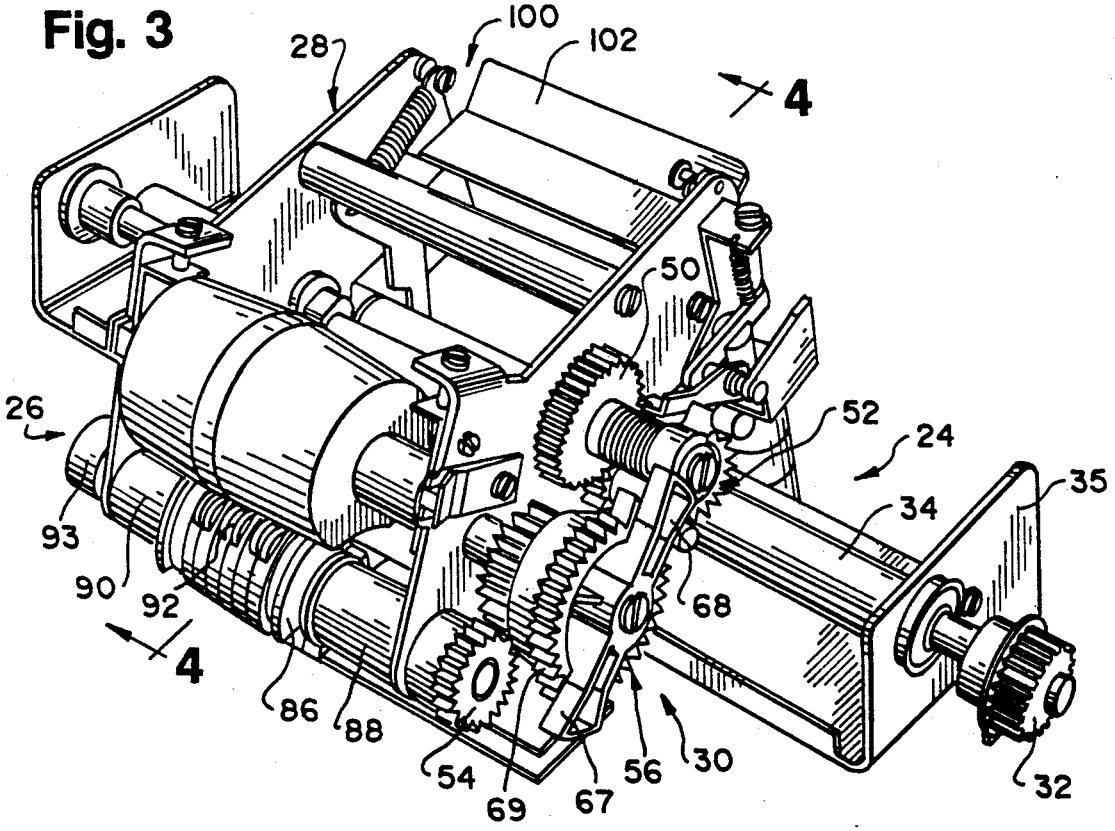
FIG. 3 is a perspective view of the endorser, illustrating the print cylinder in one actuation position.
Figure 4:
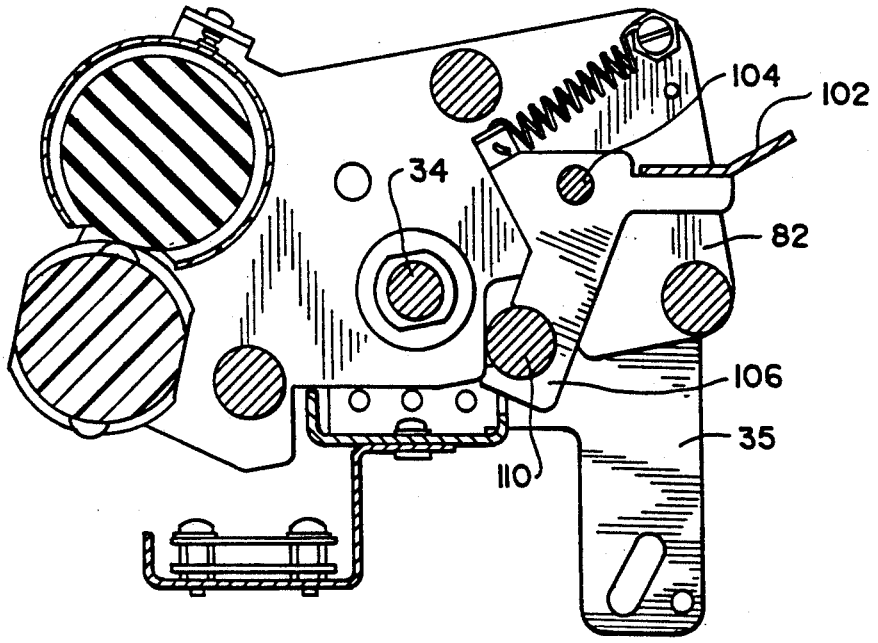
FIG. 4 is a sectional view taken along line 4—4 of FIG. 3.
Figure 5:
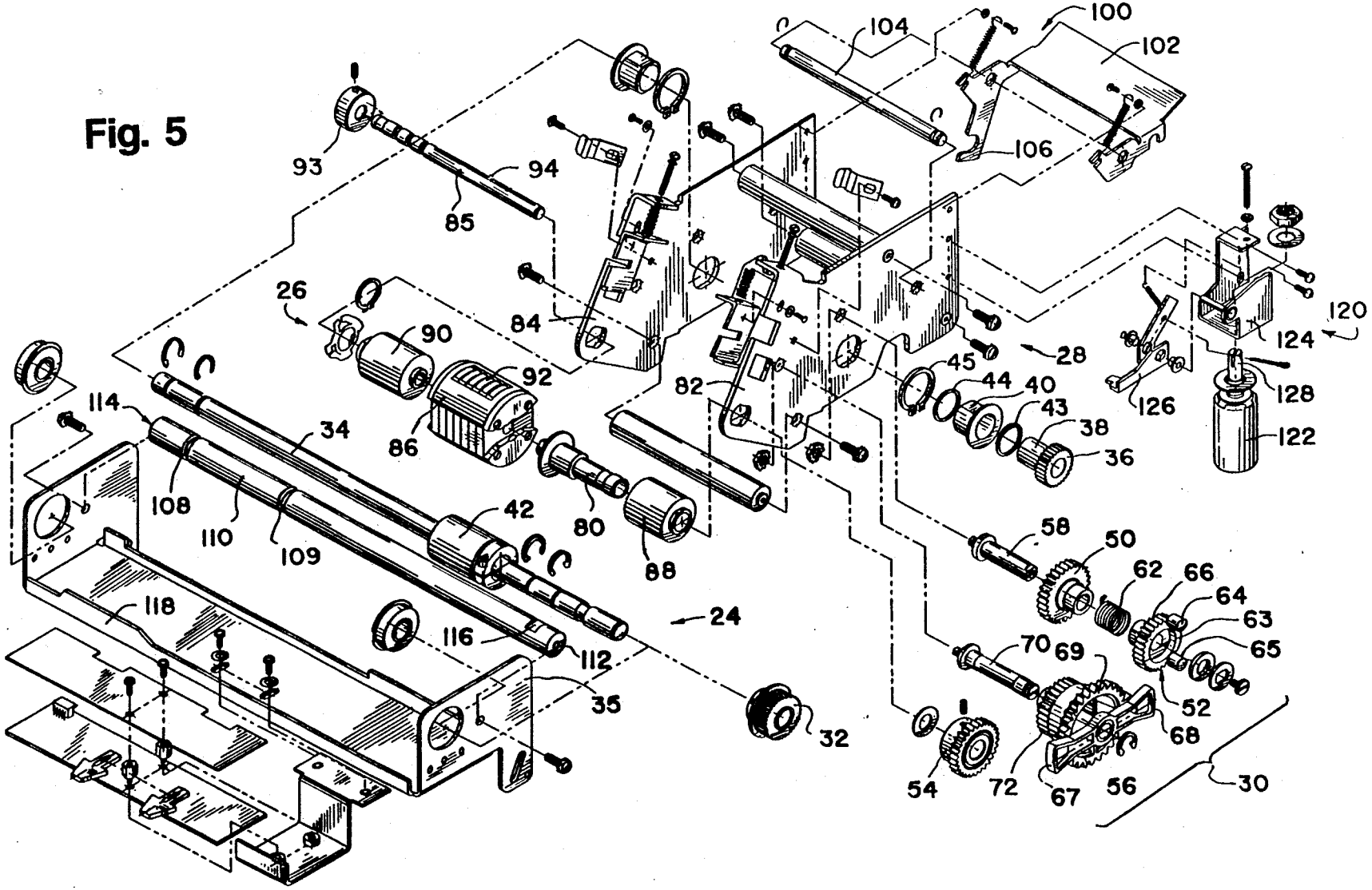
FIG. 5 is an exploded view of the endorser, illustrating the elements of FIG. 3.

The inside portion of the unit with the recorder and camera is shown in FIG. 2. The unit includes a microfilm camera 16, associated film mechanism and lens 20, as well as an endorser unit, shown generally at 22. The present invention is directed to the endorser unit 22 of the machine. The endorser unit 22 includes the recorder unit 24, a print cylinder unit 26, a housing unit 28 and an incremental drive mechanism 30, which are shown in FIGS. 2, 3 and 4.

The recorder unit 24 provides the power for the endorser unit. Power to the endorser is supplied by an electric motor (not shown) to an input pulley 32 by means of a timing belt 33. The input pulley 32 is mounted to the drive shaft 34, or first shaft. The drive shaft is supported within a base unit 35 and permitted to rotate within the base unit. Rotation of the input pulley 32 causes rotation of the drive shaft 34.

Mounted on the drive shaft 34, inward of the pulley 32, for free rotation about the drive shaft, is a pinion gear 36. The pinion gear is integral with sleeve 38 which permits physical translation of the pinion gear along the length of the longitudinal axis of the drive shaft. The sleeve of the pinion is fitted through the bearing 40.

Adjacent the bearing 40, along the drive shaft, is a translatable clutch unit 42. The pinion gear and sleeve 38 are secured within the split housing of the clutch 42. Grip rings and thrust washers 43, 44, 45, assist the attachment of the bearing and sleeve to the side plate. The clutch is freely translatable along the length of the longitudinal axis of the drive shaft. Movement of the housing along the length of the drive shaft results in corresponding movement of the clutch, pinion and bearing along the drive shaft.

The translatable clutch 42 is shown in greater detail in FIGS. 6 and 7. The clutch is preferably of the one-way type, which transmits torque in a single rotational direction; the clutch free-wheels in the reverse rotational direction. The clutch is constructed from a series of roller bearings 46 and ramps 48. The translatable clutch permits physical translation of the housing along the drive shaft from one location to another. Thus, the drive shaft can transmit power through the translatable clutch in a variety of locations along the length of the longitudinal axis of the shaft. One-way clutches of this type are commercially available as a standard part from the Torrington Company.

In the recorder unit, the timing belt drives the pulley. Rotation of the pulley causes rotation of the drive shaft, which rotates the translatable clutch and the attached pinion gear. Rotation of the pinion gear provides the drive for the incremental drive mechanism 30. The incremental drive mechanism 30 includes a series of gears 50, 52, 54 and a Geneva cam mechanism 56. The rotating pinion gear 36 provides a direct drive of the first gear 50, which is mounted on an idler shaft 58. Also mounted on the idler shaft 58 are the second gear 52 and wire clutch 62. The incremental or wire clutch is formed of a wrapped resilient wire spring.

The second gear 52 includes a rounded end portion 63, a pair of protrusions 64, 65, and a toothed portion 66. The protrusions 64, 65 contact the each of the pair of extension members 67, 68 of the Geneva cam mechanism 56. The toothed portion 66 of the second gear 52 is drivingly connected to the toothed portion 69 of the Geneva cam mechanism. The toothed portion 69 and extension members 67, 68 of the Geneva cam mechanism are both integral with the Geneva cam mechanism. The protrusions 64, 65 act to initiate movement of the extension members 67, 68 of the Geneva cam mechanism and thus rotation of the Geneva cam mechanism.

The Geneva cam mechanism is mounted for rotation on a Geneva idler shaft 70. Integral with the Geneva cam mechanism, and mounted on the idler shaft 70, is the Geneva gear 72. Rotation of the second gear 52 causes direct drive rotation of the Geneva gear 72 through toothed portion 69. As the second gear 52 rotates, the protrusions 64, 66, cause rotation of one of the Geneva extension members 67, 68.

The output of the Geneva drive mechanism is the incremental drive of the endorser, or print mechanism, by rotation of the third gear 54. The third gear is mounted about the print cylinder drive shaft 80. Mounted within the print cylinder drive shaft, between side plates 82, 84, of the housing unit, is the date adjusting shaft 85. The date adjusting shaft 85 slides within the print cylinder 86. Also included are a print cylinder drive shaft 80, and two spacer units 88, 90. The print cylinder 86 includes six date bands 92, on each side of the cylinder.

The date adjusting shaft 85 is inserted within the side panels 82, 84 of the housing, and is removable from the side panels. By retraction of the date adjusting shaft 85 and manipulation of the knob 93, the date band setting spring 94 can be manipulated to move any individual one of the six date bands 92 for changing of the date on the print cylinder.

At the end of the housing opposite the print cylinder 86, a latch mechanism is provided, as shown generally at 100. The latch mechanism 100 includes a plate member 102 that is pivotal with respect to the housing side plates 82, 84, by means of latch rod 104. The latch mechanism includes hook portion 106 at the base of the plate member 102. The hook portion is located for insertion into grooves 108, 109 in an eccentric rod 110, which is mounted into the base 35 of the endorser unit. The grooves 108, 109 are spaced to allow securing of the endorser unit into a first endorsement position and a second endorsement position along the drive shaft.

The eccentric rod 110 is termed eccentric on account of the support holes 112, 114, for attachment into the base, being drilled off-center. Thus, rotation of the eccentric rod 110 permits rotational adjustment of the position of the endorser housing and unit. Such rotational adjustment can be effective for pressure adjustment between the print cylinder 86 and the moving document (not shown). A recessed portion 116 is supplied in the eccentric rod to permit using a wrench for allowing rotational adjustment of the eccentric rod.

Also included along the base 35 is an inclined ramp portion 118, which is located between the grooved portions 108, 109 of the eccentric rod 110. As the latch plate 102 is rotated to allow release of the hook member 106 from the groove 108, and the endorser housing is moved to the second endorsement position along the drive shaft, the ramp portion 118 assists the positioning of the endorser housing. Moreover, the ramp portion requires a tilting of the endorser housing, which assures that the endorser clears the belts of the document transport mechanism 12.

A trigger mechanism, shown generally at 120, is mounted to the side plate 82, as part of the housing unit 28. The trigger mechanism includes a solenoid assembly 122, bracket 124 and lever 126. The solenoid assembly is a standard part available from Guardian Electric Company. The lever 126 is braced against the wire clutch 62, and prevents rotational movement of the wire clutch. Upon energization of the solenoid assembly by an electronic signal, the solenoid plunger 128 is retracted and the lever moved away from the wire clutch 62, which allows movement of the incremental wire clutch. The trigger mechanism and incremental drive system are known in the prior art, for use in single position endorsers.

In operation, the endorser housing is placed into a first position for receipt of documents for endorsement. Documents are fed through the document transport means into the endorser. The drive shaft 34 of the endorser is continuously rotated by the movement of the pulley 32 attached to the timing belt. Rotation of the drive shaft 34 causes rotation of the one-way translatable clutch 42 and the pinion gear 36 attached to the clutch. Rotation of the pinion gear 36 drives the first gear 50. The gear 50 freewheels about the idler shaft 58.

When the moving document is properly positioned for endorsement, an electronic signal is sent to actuate the solenoid. The location of the position of the document and actuation of the electronic solenoid is undertaken by an electronic control which is not shown. Such controls are available in the prior art. Upon actuation of the solenoid assembly 122, the lever 126 is raised and the incremental clutch 62 is allowed to rotate along with the rotation of the first gear 50. The rotation of the first gear 50 and the incremental wire clutch 62 causes the rotation of the second gear 52 and the Geneva cam mechanism 56. Rotation of the Geneva gear causes rotation of the third gear 54 through Geneva gear 72 which rotates the print cylinder 86 on the print drive shaft 80. The extension members 67, 68 of the Geneva unit cause 180 degree rotation of the print cylinder. The wire clutch 62 also acts to prevent rotation beyond 180 degrees, in order that a single endorsement is made on the moving document.

In the first endorsement position, checks are fed through the endorser unit by the document transport means 12. The checks are placed in a stack and then the document transport means selects the individual checks from the top of the stack. The electronic control triggers the print mechanism to place a single endorsement in the set location on each check as it moves through the endorser unit.

In order to endorse documents in a second position or different location side-to-side, on the reverse side of the check, the endorser housing, which includes the endorser drive mechanism and the print mechanism as an integral unit, is moved to a second endorsement position along the drive shaft. The latch plate 102 is rotated to release the hook member 106 from the groove 108. The entire housing is then tilted to move along the ramp portion 118 as the housing and the units are translated along the length of the drive shaft. The translatable clutch 42 permits the drive unit to be translated or moved along the length of the drive shaft to the second position. The location in the second position is secured by the placement of the hook member 106 in the groove 109.

In the second position, the endorser is operated to print endorsements on the moving document in the same manner as described above. Each document is imprinted with a single endorsement. Two positions can be achieved along the shaft by the inclusion of grooves 108, 109 at either location along the shaft. Thus, the endorsements may be made at separate and discrete locations along the shaft. Endorsement in a third position is achieved by reversing (side-to-side) the orientation of the checks.

FIG. 8 illustrates the reverse side of a standard bank check and the three positions for endorsements. As noted above, in accordance with government regulations, the payee's endorsement is permitted only in the left-hand portion 140 of the reverse side of the check. The endorsement of the bank of first deposit is permitted only in the center portion 145 of the check. Any subsequent bank's endorsement is permitted only in the right-hand portion 150 of the check. The right-hand portion 150 of the check is accessed by reversing the positioning of the checks in side-to-side relation.

The endorser unit of the present invention allows each bank to place its endorsement in the specified location. Depending on whether the bank is the payee, the bank of first deposit, or the bank of subsequent deposit, the endorser unit of the present invention can be positioned to provide the endorsements on a number of checks in the particular required location. The endorser unit can be moved along the shaft to the desired location and then driven in that location to provide endorsements on multiple checks. Of course, the checks must be fed in the proper orientation. The additional features that have been described allow flexibility and other efficiencies in use.

While the preferred embodiment of this invention is illustrated, it will be understood that the invention is not limited to the illustrated embodiment. Those skilled in the art to which the invention pertains may make modifications and other embodiments employing the principles of the invention, particularly upon considering the foregoing teachings.

What is claimed is:

1. A multi-position document endorser having a plurality of endorsement positions for printing a single endorsement in a plurality of discrete locations on a moving sheet during separate passes through the endorser, comprising:

print means for placing a printed endorsement mark on a moving sheet, said print means providing a single imprint on said moving sheet;

document transport means for transporting said moving sheet;

housing means for holding said print means in a first endorsement position, said housing means having a configuration for physical translation of said housing means to permit movement of said print means to a second endorsement position; and endorser drive means for incremental actuation of said print means in said first endorsement position to permit endorsement in a first location, said endorser drive means having a configuration for physical translation of said endorser drive means to permit actuation of said print means in said second position to permit endorsement in a second location;

wherein said endorser drive means includes a clutch means for actuation of said endorser drive means in said first and second endorsement positions, said clutch means having a configuration for physical translation of said clutch means between said first and second endorsement positions.

2. The endorser set forth in claim 1 wherein said endorser drive means is integral with said housing means.

3. The endorser set forth in claim 1, further including a drive shaft, said housing means being pivotally mounted on said drive shaft, said housing means being configured for physical translation along the longitudinal axis of said drive shaft.

4. The endorser set forth in claim 1 further including a drive shaft, said clutch means including a one-way clutch, a bearing and a pinion gear disposed about said drive shaft, said pinion gear being operatively coupled to said one-way clutch.

5. The endorser set forth in claim 4 wherein said pinion gear is drivingly coupled to an incremental drive mechanism, said incremental drive mechanism including an incremental clutch and a solenoid actuator.

6. The endorser set forth in claim 5 wherein said solenoid actuator is operatively connected to said incremental clutch, actuation of said solenoid actuator being effective to release said incremental clutch to permit rotation of said print means.

7. The endorser set forth in claim 6 wherein said incremental clutch is a resilient wire spring.

8. The endorser set forth in claim 4 wherein said housing means includes latch means for retaining said housing means in said first endorsement position.

9. The endorser set forth in claim 8 wherein said housing includes a set of side plates, said latch means includes a plate member pivotally mounted to said set of side plates, and a retention member formed in said plate member.

10. A multi-position document endorser having a plurality of endorsement positions for printing a single endorsement in a plurality of discrete locations on a moving sheet during separate passes through the endorser, comprising print means for placing a printed endorsement mark on a moving sheet, said print means providing a single imprint on said moving sheet;

document transport means for transporting said moving sheet;

housing means for holding said print means in a first endorsement position, said housing means having housing translation means for physical translation of said housing means along said drive shaft; said translation means permitting movement of said print means to a second endorsement position;

endorser drive means for incremental actuation of said print means in said first endorsement position to permit endorsement in a first location, said endorser drive means having endorser drive translation means for physical translation of said endorser drive means to permit actuation of said print means in said second position to permit endorsement in a second location;

said endorser drive means including clutch means for actuation of said endorser drive means in said first and second endorsement positions, said clutch means having a configuration for physical translation of said clutch means between said first and second endorsement positions;

a drive shaft, said clutch means including a one-way clutch, a bearing and a pinion gear disposed about said drive shaft, said pinion gear being operatively coupled to said one-way clutch;

said housing means including latch means for retaining said housing means in said first endorsement position;

said housing means including a set of side plates, said latch means including a plate member pivotally mounted to said set of side plates, and a retention member formed in said plate member;

a second shaft, said latch means further including a grooved portion in said second shaft, said grooved portion being positioned for receiving said retention member to retain said housing means in said second endorsement position.

11. The endorser set forth in claim 10 wherein said second shaft if configured for adjustment.

12. The endorser set forth in claim 10 wherein said endorser includes a base portion, said second shaft being mounted to said base portion, said second shaft including a pair of mounting holes, one hole being located at each end of said second shaft, said mounting holes being eccentrically located with respect to the center of the cross section of said shaft.

13. The endorser set forth in claim 10 wherein said second shaft includes a plurality of grooved portions, said grooved portions being located to position said housing means in said first endorsement position and said second endorsement position.

14. The endorser set forth in claim 10 wherein said base portion includes an inclined portion to direct movement of said housing means from said first endorsement position to said second endorsement position.

15. A multi-position endorser having a plurality of endorsement positions for permitting a single endorsement in a plurality of locations on a moving sheet, comprising print means for placing a printed mark on a moving sheet, said print means providing a single imprint on said moving sheet during a single pass through said endorser;

document transport means for transporting said moving sheet;

a drive shaft;

housing means for holding said print means in a first endorsement position; said housing means having housing translation means for physical translation of said housing means along said drive shaft; said translation means permitting movement of said print means to a second endorsement position; said housing means being pivotally mounted on said drive shaft, said physical translation of said housing being along the longitudinal axis of said drive shaft;

endorser drive means for actuation of said print means in said first endorsement position to permit endorsement in a first location; said endorser drive means having endorser drive translation means for physical translation of said endorser drive means to permit actuation of said print means in said second endorsement position to permit endorsement in a second loction; said endorser drive means including clutch means for actuation of said endorser drive means in said first and second endorsement positions, said clutch means having clutch translation means for physical translation of said clutch means between said first and second endorsement positions.

16. The endorser set forth in claim 15 wherein said moveable clutch means rotates in a single direction.

* * * * *